US006079164A

United States Patent [19]

Lanzani

[11] Patent Number: 6,079,164

[45] Date of Patent: Jun. 27, 2000

[54] DEVICE FOR CONNECTING TWO PANELS TOGETHER AND FOR ADJUSTING THEIR SPATIAL ARRANGEMENT

[76] Inventor: Oreste Lanzani, Via Rosselli, 1, Bagnolo Mella (Brescia), Italy

[21] Appl. No.: 09/099,496

[22] Filed: Jun. 18, 1998

[30] Foreign Application Priority Data

Jul. 7, 1997 [IT] Italy ..... MI97A1604

[51] Int. Cl.[7] ..... E04B 1/38

[52] U.S. Cl. ..... 52/127.1; 52/127.12; 52/582.1; 52/506.05; 52/512; 403/11; 248/316.1; 248/316.4

[58] Field of Search ..... 52/127.1, 127.7, 52/127.12, 582.1, 578, 506.05, 512, 509, 235, 126.3, 126.4, 506.06, 511; 403/11, 12, 13, 14, 388, 384; 248/300, 316.1, 316.4, 257, 269

[56] References Cited

U.S. PATENT DOCUMENTS

| | | | |
|---|---|---|---|
| 1,883,834 | 10/1932 | Turner | 248/300 X |
| 2,818,948 | 1/1958 | Jones | 52/578 |
| 2,986,627 | 5/1961 | Marriett | 248/316.1 X |
| 3,868,800 | 3/1975 | Peterson | 52/126.3 X |
| 4,523,413 | 6/1985 | Koppenberg | 52/509 X |
| 4,720,952 | 1/1988 | Fricker | 52/235 |
| 4,744,191 | 5/1988 | Fricker | 52/235 X |
| 5,138,809 | 8/1992 | Saikachi | 52/512 X |
| 5,224,309 | 7/1993 | Bodell | 52/127.1 |
| 5,265,396 | 11/1993 | Amimoto | 52/235 X |
| 5,471,709 | 12/1995 | Lanzani . | |

FOREIGN PATENT DOCUMENTS

| | | | |
|---|---|---|---|
| 5-18088 | 1/1993 | Japan | 52/506.05 |
| 5-118110 | 5/1993 | Japan | 52/506.05 |

*Primary Examiner*—Christopher T. Kent
*Assistant Examiner*—Brian E. Glessner
*Attorney, Agent, or Firm*—Steinberg & Raskin, P.C.

[57] ABSTRACT

This disclosure concerns a connecting device for connecting a first panel onto a second panel, the connecting device having a substantially plate-like connecting element including an aperture therein, where the connecting element has a first flat part structured and arranged to engage an inner face of the first panel and a second flat part structured and arranged to engage an inner face of the second panel, and wherein the second part is located in a different plane from and is substantially parallel to the first flat part. The disclosure also describes a device having an adjuster element disposed within the aperture of the connecting element, the adjuster element including a horizontally elongated slot and a means for moving the adjustable element within the aperture for adjustable movement in a vertical direction with respect to the connecting element in order to provide independent adjustment in either the horizontal or vertical directions.

10 Claims, 2 Drawing Sheets

DEVICE FOR CONNECTING TWO PANELS TOGETHER AND FOR ADJUSTING THEIR SPATIAL ARRANGEMENT

This invention relates to a device for connecting a first panel, in particular a cover panel, onto a second panel, in particular a door of a built-in household electrical appliance, for example a refrigerator.

In built-in household electrical appliances and in particular in refrigerators, on opening (or closing) the door of the furniture item into which the refrigerator is built, the refrigerator door is also required to open (or close) simultaneously. For this purpose the door of the furniture item into which the refrigerator is built, or a cover panel, is generally secured to the refrigerator door.

To secure the cover panel Lo the refrigerator door it is known to use suitably shaped plates fixed by screws to the opposing faces of the door and panel.

This operation is however generally relatively lengthy, difficult and costly. In this respect the panel has to be accurately positioned relative to the door and to the compartment within which the refrigerator is built, numerous vertical and horizontal adjustments often being required.

To obviate the aforesaid drawbacks, the present applicant has proposed in a previous Italian patent application (No. MI93A000027) a hinge which eminently overcomes the aforesaid drawbacks.

This hinge is however relatively difficult to adjust if the opening direction is reversed. In this case the panel position is no longer adjusted by adjusting the upper hinge, but instead by adjusting the lower hinge.

If it is required to use not the aforesaid hinge but a hinge of traditional type, the panel position can be adjusted by further complex and costly devices. Similar technical problems are also present in the furniture field, in which connecting a panel or another similar element to a panel or a generic support structure is often problematic.

An object of this invention is to provide a device for connecting a panel, in particular a cover panel, to an underlying panel, for example a door of a household electrical appliance, which enables the position of the outer panel to be easily and quickly adjusted relative to the underlying panel, whether traditional hinges or hinges of the type patented by the present applicant are mounted.

A further object is to provide an easily constructed and assembled device which comprises a small number of components and is of low production cost.

These and further objects which will be apparent to an expert of the art are attained by a device in accordance with the characterising part of the main claim.

The invention will be more apparent from the accompanying drawings, which are provided by way of non-limiting example and on which:

Figure 1:
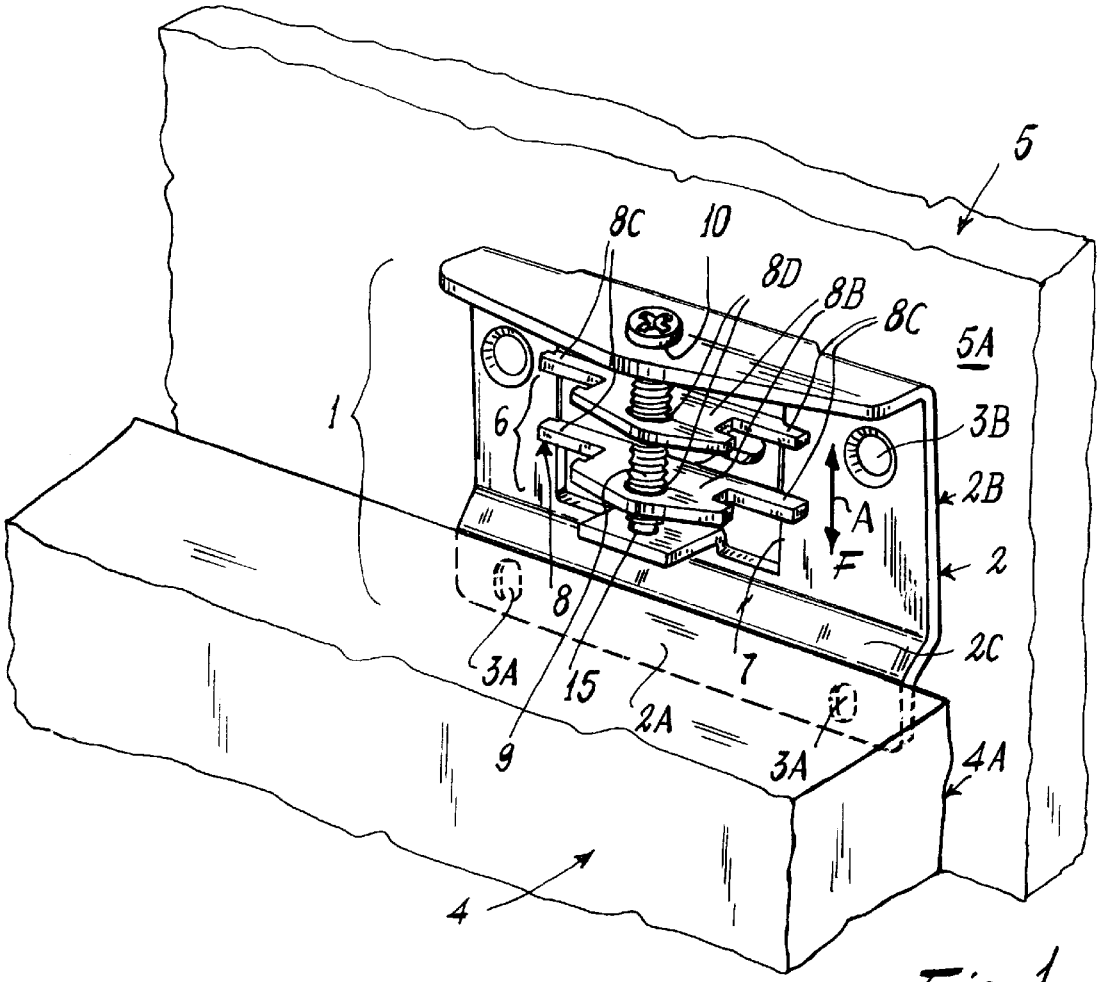
FIG. 1 is a schematic perspective view of a device of the invention applied to a refrigerator door and to a cover panel (these latter being partially shown)
Figure 2:
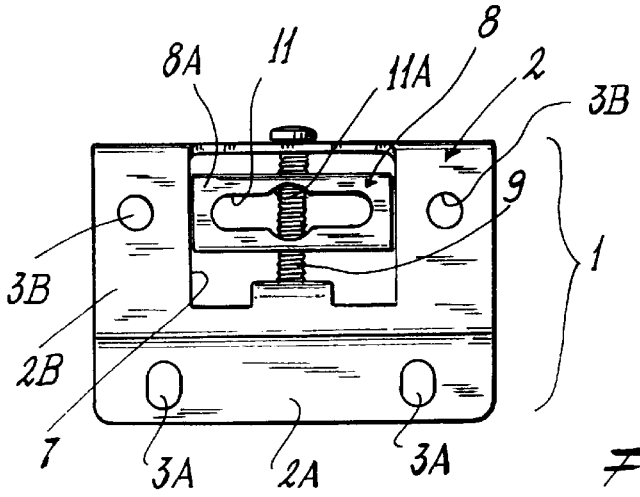
FIG. 2 is a view of that face thereof which adheres to the panel.

With reference to said figures, a device of the invention, indicated overall by 1, comprises a substantially plate-like connection element 2, provided with four holes 3A, 3B for the passage of conventional screws (17, 18, FIG. 6) for fixing this element to the outer face 4A of the door 4 of a household electrical appliance, in particular a refrigerator (the door is shown partially in FIG. 1), and to the inner face 5A of a cover panel for the refrigerator door. The connection element 2 also comprises means, indicated overall by 6, for adjusting the horizontal and vertical arrangement of the panel 5 relative to the door 4, before the connection element is rigidly secured to the panel by screws. Specifically, the connection element comprises a first flat part 2A to be fixed to the outer face 4A of the refrigerator in correspondence with its upper edge, and a second flat part 2B to be fixed to the inner face 5A of the panel. The second part 2B lies in a plane different from the part 2A but parallel thereto and is connected to this latter by a part 2C.

The part 2B centrally comprises an aperture 7 within which there is movable an adjuster 8 connected to the connection element 2 by a screw 9 engaging in a hole 10 and in a hole 15 which are provided in two parts bent perpendicular to the plane in which the aperture 7 lies.

The adjuster 8 is of the type comprising a flat wall 8A which slides vertically within the aperture 7. This wall has a longitudinal slot 11 with a head passage hole 11A. The flat wall 8A also has two parts 8B bent at 90°, comprising flanges 8C and two threaded holes 8D for passage of the screw 9.

Figure 3:
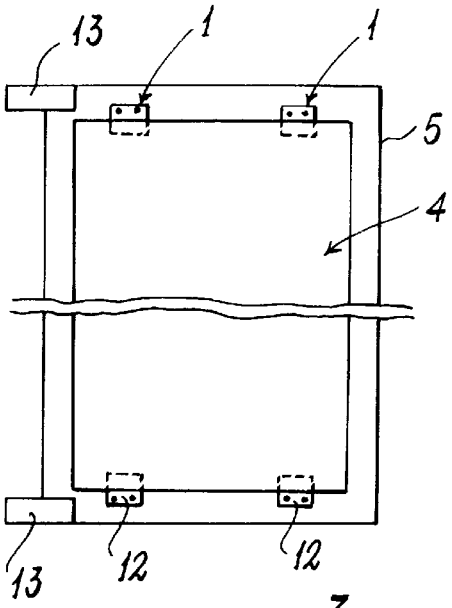
FIGS. 3 and 4 are schematic views of the inner surface of a refrigerator door connected to a cover panel by devices of the invention.

If two usual devices 13 are present (FIG. 3), the device of the invention is used in pairs. The two devices are located in proximity to the two upper corners of the refrigerator door (as shown in FIG. 3). Alternatively, if a hinge of the type patented by the present applicant is used, a single device of the invention is positioned on that side distant from the side comprising the hinge. Said hinge contains within itself panel adjustment devices which can operate in combination with the present invention and are therefore able to replace one of them.

On rotating the screws 9 the adjuster 8 is moved in the direction of the arrow A, to consequently vertically set the panel into the most suitable position. In this respect, if a panel 5 is to be secured to a refrigerator door 4 by two devices of the invention, it is firstly necessary to fix the part 2A of two plate elements in correspondence with the upper corners of the refrigerator door (as shown schematically in FIG. 3). Two positioning screws are then fixed to the face SA of the panel 5 so that they engage the slots 11. The screws project a certain distance from the panel 5 and have a cylindrical head of diameter such that it can be inserted through the central part 11A of the slot 11, and a shank which enables it to slide within the slot. The panel is then "suspended" from the refrigerator door by inserting the screws, previously fixed to the panel 5, through the slots 11. At this point, by operating the screws 9 the panel position can be adjusted vertically relative to the refrigerator door, whereas the "horizontal" position of the panel can be adjusted by moving the panel 5 to the right or left of the door so that the positioning screws slide within the slots 11. When the optimum arrangement has been found for the panel, it is secured rigidly to the plate element and hence to the refrigerator door by screws 17 (FIG. 6) passing through the holes 3B in the element.

The panel is secured lowerly to the door by usual plates 12 (FIG. 3), previously fixed to the lower edge of the refrigerator door.

In this manner, traditional hinges 13 can be used to connect the panel to the furniture item in which the refrigerator is to be housed, while considerably simplifying and accelerating the operations involved in connecting the panel to the door.

Figure 4:
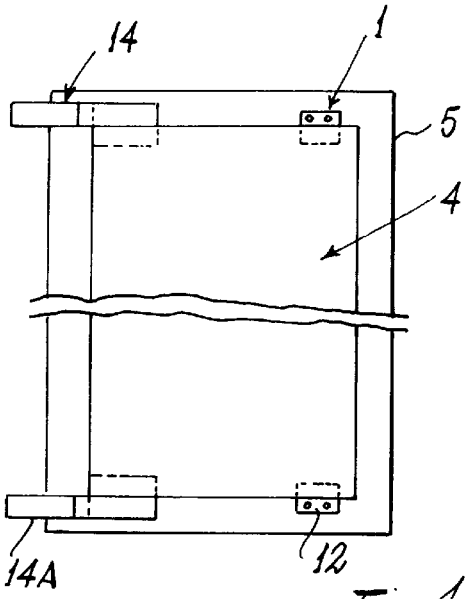

FIG. 4 shows a refrigerator door 4 and a panel 5 connected together by a hinge 14 of the type described in the aforesaid patent application.

Again in this case it is advantageous to use a device of the invention at the top of the door, on the opposite side to that on which the hinge 14 is applied. In this manner, by applying two positioning screws to the panel (one for the hinge and one for the plate element) the panel arrangement can be adjusted by merely adjusting the upper hinge and the device of the invention. Having made this adjustment, the lower hinge 14A and the panel 12, previously fixed to the refrigerator door 4, are secured to the panel 5 by screws.

By virtue of the device of the invention, the opening direction of the door can be very easily reversed.

Figure 5:
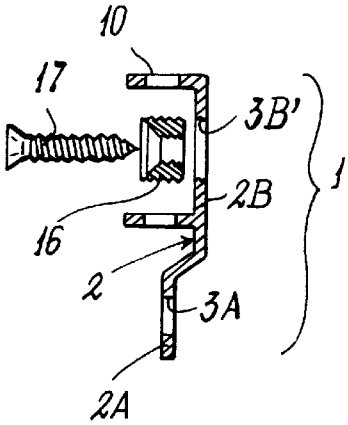
FIGS. 5 and 6 are two sections through a modified embodiment of the device which also enables the distance between the two panels to be adjusted.
Figure 6:
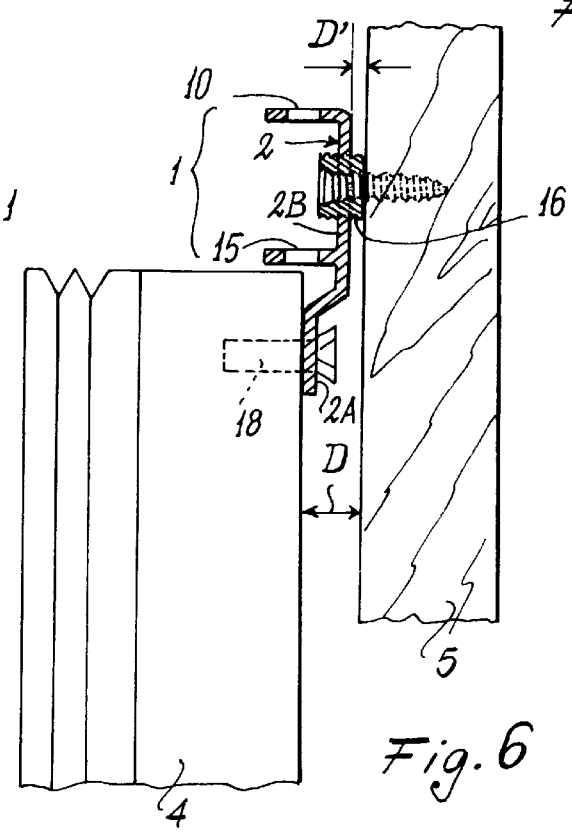

FIGS. 5 and 6 show a modification of the device of the invention identical to the aforedescribed (the adjustment means 6 are omitted from FIGS. 5 and 6 to simplify the drawings) which however also allows adjustment of the distance D between the opposing faces of the panel 5 and door 4 to be connected together. For this purpose the holes 3B' of the plate element 2 are threaded so that they can engage an externally threaded bush 16. By rotating the bushes 16 within the holes 3B', the distance D' between the panel 5 and the part 2B of the device is varied, so adjusting the distance D between the panel 5 and the door 4.

Finally it should be noted that, even though the aforegoing description refers only to cover panels for doors of built-in refrigerators, the device of the invention can also be used in the furniture field for connecting together parts of any type which are required to be superposed. Hence in the present context, the term "panel" is to also include a structure of other than flat shape. In this respect, instead of the door 4, a simple frame to be faced with a panel 5 of quality material could be provided.

I claim:

1. A connecting device for connecting a first panel onto a second panel, said connecting device comprising:

a substantially plate-like connecting element having an aperture therein, said connecting element comprising a first flat part structured and arranged to engage an inner face of the first panel and a second flat part structured and arranged to engage an inner face of the second panel, wherein said second part is located in a different plane from and is substantially parallel to said first flat part;

an adjuster element disposed within said aperture of said connecting element, said adjuster element including a horizontally elongated slot; and means for moving said adjustable element within said aperture for adjustable movement in a vertical direction with respect to said connecting element.

2. The connecting device according to claim 1, further comprising a positioning element structured and arranged to be affixed to said second panel, said positioning element received by said horizontally elongated slot of said adjuster element and structured and arranged to suspend and allow horizontal adjustment of said second panel relative to said first panel.

3. The connecting device according to claim 2, wherein said means for moving and positioning said adjustable element are screws.

4. The connecting device according to claim 1, wherein said connecting element further comprises means for varying a lateral distance between said first and second panels.

5. The connecting device according to claim 4, wherein said second flat part of said connecting element further comprise at least one threaded hole and wherein said means for varying is an externally threaded bushing engaging said threaded hole in said second flat part.

6. A connecting device comprising:

an outer panel and an inner panel;

a substantially plate-like connecting element having an aperture therein, said connecting element comprising a first flat part that engages an inner face of said inner panel and a second flat part that engages an inner face of said outer panel, wherein said second part is located in a different plane from and is substantially parallel to said first flat part;

an adjuster element disposed within said aperture of said connecting element, said adjuster element including a horizontally elongated slot; and means for moving said adjustable element within said aperture for adjustable movement in a vertical direction with respect to said connecting element.

7. The connecting device according to claim 6, further comprising a positioning element affixed to said outer panel, said positioning element received by said horizontally elongated slot of said adjuster element and structured and arranged to suspend and allow horizontal adjustment of said second panel relative to said first panel.

8. The connecting device according to claim 7, wherein said means for moving and positioning said adjustable element are screws.

9. The connecting device according to claim 7, wherein said connecting element further comprises means for varying a lateral distance between said inner and outer panels.

10. The connecting device according to claim 9, wherein said second flat part of said connecting element further comprises at least one threaded hole and wherein said means for varying is an externally threaded bushing engaging said threaded hole in said second flat part.

* * * * *